United States Patent [19]

Wolfger

[11] Patent Number: 4,926,551

[45] Date of Patent: May 22, 1990

[54] DRY-SHAVING APPARATUS COMPRISING AT LEAST ONE SHUTTER WHICH IS SLIDABLE ON THE APPARATUS HOUSING

[75] Inventor: Arno Wolfger, Klagenfurt, Austria

[73] Assignee: U.S. Philips Corp., New York, N.Y.

[21] Appl. No.: 184,309

[22] Filed: Apr. 21, 1988

[30] Foreign Application Priority Data

Apr. 24, 1987 [AT] Austria ..... A 1026/87

[51] Int. Cl.[5] ..... B26B 19/02

[52] U.S. Cl. ..... 30/43.92; 30/34.05

[58] Field of Search ..... 30/32, 34 R, 43.91, 30/43.92, 90, 34.05

[56] References Cited

FOREIGN PATENT DOCUMENTS 1122410 1/1962 Fed. Rep. of Germany ..... 30/34 R

*Primary Examiner*—Douglas D. Watts

*Attorney, Agent, or Firm*—Ernestine C. Bartlett

[57] ABSTRACT

In a dry-shaving apparatus comprising at least one shutter (4) which is slidable on the apparatus housing (3) for optionally covering or exposing a shear foil, the shutter-wall surface (14) which faces the apparatus housing is spaced from the apparatus housing, at least one sliding guide means (15;16) acting between the shutter and the apparatus housing to provide localized areas of contact between the shutter and the apparatus housing in the sliding direction of the shutter.

9 Claims, 2 Drawing Sheets

DRY-SHAVING APPARATUS COMPRISING AT LEAST ONE SHUTTER WHICH IS SLIDABLE ON THE APPARATUS HOUSING

BACKGROUND OF THE INVENTION

The invention relates to a dry-shaving apparatus comprising at least one shutter which is slidable on the apparatus housing for optionally covering or exposing a shear foil of the dry-shaving apparatus, and which is laterally guided at both sides in groove-shaped guides on the apparatus housing. Such a dry-shaving apparatus is known from DE-AS No. 11 22 410.

SUMMARY OF THE INVENTION

It is the object of the invention to construct a dry-shaving apparatus of the type defined in the opening sentence in such a way that the shutter is readily slidable on the apparatus housing, without causing damage to the apparatus housing. To this end, according to the invention, the shutter-wall surface which faces the apparatus housing is spaced from the apparatus housing and at least one sliding guide means acts between the shutter and the apparatus housing to provide localized areas of contact between the shutter and the apparatus housing in the sliding direction of the shutter. In this way, the shutter and the apparatus housing are designed to contact one another only over comparatively small areas instead of over a large area, so that the shutter is smoothly slidable over the apparatus housing without any substantial friction. Moreover, since the wall surface of the shutter is spaced front the housing, this ensures that during sliding of the shutter the apparatus housing is not damaged, and in particular is not scratched, which would adversely affect the appearance of these parts of the apparatus housing which are not covered by the shutter. In the case of a dry-shaving apparatus comprising a shaving head frame which is detachable secured to a basic apparatus and whose cross-members retain the shear foil, it is obvious that such a shaving-head frame must also be regarded as a part of the apparatus housing, so that such a sliding guide means may also be provided at the location of such a frame.

Preferably the sliding guide means comprises at least one rib which is oriented to act substantially in the sliding direction of the shutter.

Such a rib may be arranged, for example, on the shutter-wall surface which faces the apparatus housing. However, it is especially preferred that the rib be arranged on the apparatus housing. Since the apparatus housing is generally made of a harder material than the shutter, the arrangement of the rib on the apparatus housing results in an improved sliding guide means, which also is less subject to wear.

In this respect it is also preferred that the shutter-wall surface which faces the apparatus housing be provided with a steel foil at least in the area of the shutter end which is remote from the shear foil, the shutter sliding on the rib with said steel foil. Such a steel foil constitutes a hard surface, which improves the characteristics of the sliding guide means and eliminates the risk of the rib on the apparatus housing digging into the shutter-wall surface which faces the apparatus housing, which could impair the easy slidability of the shutter and cause the shutter to contact the apparatus housing over a larger area and thereby scratch the apparatus housing. This step is of particular importance in the area of the shutter end which is remote from the shear foil, because at this area manual pressure is applied when the shutter is moved and the sliding guide means is thus subjected to higher load.

Also, in especially preferred embodiments, the sliding guide means comprises rolling elements which project from the apparatus housing and which are arranged in line with each other in the sliding direction of the shutter. This also provides an effective sliding guidance for the shutter, which keeps the shutter spaced from the apparatus housing, the shutter and the apparatus housing being in contact with one another over very small areas. The rolling elements may comprise balls or rollers.

In this respect it is also found to be advantageous if the shutter-wall surface which faces the apparatus housing is provided with a groove which extends in the sliding direction of said shutter and which is engaged by the rolling elements of the sliding guide means arranged on the apparatus housing. Such a groove improves the characteristics of the sliding guide means for the shutter and also constitutes a rectilinear guideway for the shutter movement.

BRIEF DESCRIPTION OF THE DRAWING

Some embodiments of the invention will now be described in more detail, by way of example, with reference to the accompanying drawings.

DETAILED DESCRIPTION OF THE PREFERRED EMBODIMENTS

Figure 1:
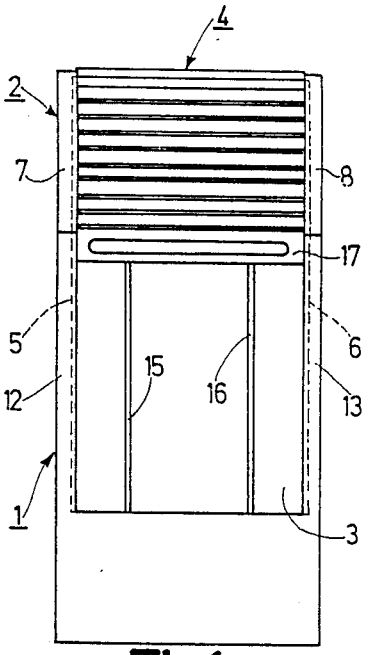
FIG. 1 shows a dry-shaving apparatus with a shutter covering the shear foil, two sliding guide means acting between the shutter and the apparatus housing, which means each comprise a rib arranged on the apparatus housing.
Figure 2:
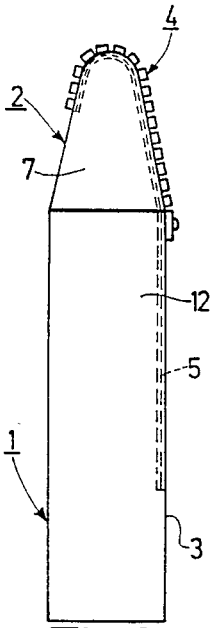
FIG. 2 is a side view of the dry-shaving apparatus of FIG. 1.
Figure 3:
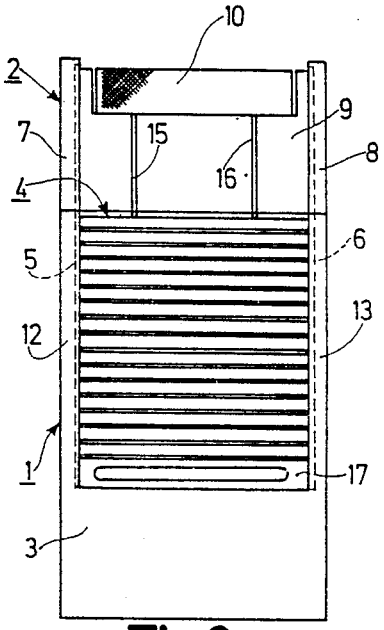
FIG. 3 shows the dry-shaving apparatus of FIG. 1 with the shear foil exposed by the shutter.

FIGS. 1 and 2 show a dry-shaving apparatus comprising a basic apparatus 1 and a shaving-head frame 2 mounted on this basic apparatus, together forming an apparatus housing 3. In a manner not shown, for example by means of at least one resilient latch, the shaving-head frame 2 is detachably secured to the basic apparatus 1. Such a shaving-head frame serves for holding an arcuate shear foil, which in the situation of FIGS. 1 and 2 is covered completely by a shutter 4 to protect the shear foil when the dry-shaving apparatus is not in use. This shutter 4 is slidably arranged on the apparatus housing 3, the shutter being laterally guided at both sides in groove-shaped guides 5 and 6 in the apparatus housing 3, as indicated in broken lines in FIGS. 1 and 2. The shutter 4 can be slid from the basic apparatus 1 onto the shaving-head frame 2 and the shear foil, for which purpose the shutter guides 5 and 6 in the basic apparatus 1 are continued in the side walls 7 and 8 of the shaving-head frame 2, where they are curved in conformity with the curvature of the shear foil. If the dry-shaving apparatus is to be used, the shutter 4 is slid back from its position shown in FIGS. 1 and 2 onto the basic apparatus 1 to expose the shear foil for the purpose of shaving, as is shown in FIG. 3, where it has been slid back so far that it is also clear of the shaving-head frame 2, enabling said frame to be removed from the basic apparatus 1, for example for cleaning purposes or for replacing the shear foil 10 which is retained by means of the cross-members 9 of the shaving-head frame 2. Such a shutter 4 is required to have a satisfactory stability in the transverse direction, so as to provide adequate protection for the shear foil 10, and to have a satisfactory flexibility in the longitudinal direction, so as to enable it to adapt itself to the shape of a shear foil 10 even it it has a comparatively sharp curvature. In order to meet such requirements the shutter comprises, for example, an elastic carrier and spaced-apart slots connected to said carrier.

Such a shutter is required to be readily slidable on the apparatus housing and, as it is moved, it should not damage, in particular it should not scratch, the apparatus housing. In order to achieve this the wall surface of the shutter 4 which faces the apparatus housing 3 is spaced from the apparatus housing 3 and at least one sliding guide means acts between the shutter 4 and the apparatus housing 3 to provide localized areas of contact between the shutter 4 and the apparatus housing 3 in the sliding direction of the shutter.

Figure 4:
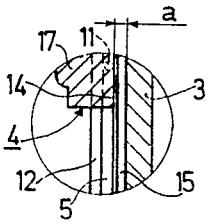
FIG. 4, in side view and sectional view, shows a part of the shutter-guidance area.
Figure 5:
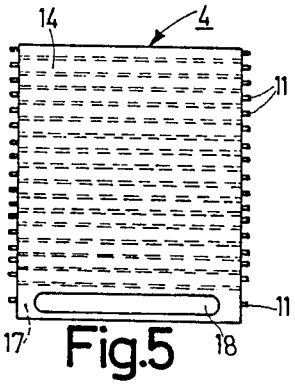
FIG. 5 shows a shutter intended for use in a dry-shaving apparatus as shown in FIG. 1 in a plan view at its wall surface which faces the apparatus housing of the dry-shaving apparatus on which it is mounted.

As can be seen in FIG. 4, which shows a part around the area of the guide 5, groove-shaped guides 5 and 6, for laterally guiding the shutter 4 at both sides and which are engaged by, for example, lateral projections 11 of the shutter shown in FIG. 5, are formed in raised lateral wall portions 12 and 13 of the apparatus housing 3 and are situated at such a level that the wall surface 14 of the shutter 4 which faces the apparatus housing 3 is spaced from the apparatus housing 3. This distance, designated a in FIG. 4, is selected in such a way that no contact over a larger area is possible between the wall surface 14 of the shutter 4 which faces the apparatus housing 3 and the apparatus housing 3, so that the shutter 4 is smoothly slidable over the apparatus housing 3 without any significant friction and so as to preclude damaging, in particular scratching, of the apparatus housing 3.

Moreover, between the shutter 4 and the apparatus housing 3 sliding guide means are provided, which in the present embodiment comprise two ribs 15 and 16 which extend in the sliding direction of the shutter and which are formed on the apparatus housing 3 and also on the the cross-members 9 of the shaving-head frame 2, as can be seen in FIG. 3. The wall surface 14 of the shutter 4 which faces the apparatus housing 3 is in sliding contact with said ribs 15 and 16, so that there is only a localized contact between the shutter 4 and the apparatus housing 3, because the shutter and the apparatus housing contact each other only over a comparatively small area. In this way the ribs 15 and 16 locally support the shutter 4 and keep the wall surface 14 which faces the apparatus housing 3 spaced from said housing 3. Such supporting means are important in order to ensure that the shutter 4 cannot bend under the influence of the manual pressure applied to it when it is slid over the apparatus housing 3, so that the specified distance a relative to the apparatus housing is always maintained.

Since in the present case the ribs 15 and 16 are arranged on the apparatus housing, it is preferred that they be made of the same comparatively hard material as the apparatus housing 3 resulting in a satisfactory sliding guidance and hardly any wear. Since the material used for a shutter is generally not as hard as the material used for the apparatus housing, the ribs 15 and 16 may dig into the wall surface 14 of the shutter 4 which faces the apparatus housing 3, as a result of which the shutter may no longer be spaced at the correct distance from the apparatus housing. This applies in particular to the area of that end of the shutter 4 which is remote from the shear foil 10 and which in practice, in order to move the shutter, is gripped by hand and is therefore subjected to pressure. This end portion of the shutter may be specially constructed as a gripping element 17. In this respect, it is preferred in this area of the end portion of the shutter 4 that the shutter-wall surface 14 which faces the apparatus housing 3 be provided with a steel foil 18, as is shown in FIG. 5. Thus, the supporting surface for the ribs 15 and 16 on the shutter 4 is hard, has satisfactory sliding properties, and is not subject to wear. Obviously, it is also possible to provide the entire wall surface 14 of the shutter 4 which faces the apparatus housing 3 with a steel foil. In the present embodiment the steel foil 18 extends substantially across the full width of the shutter 4, so that it is firmly attached to the shutter. However, in principle, it is also possible to arrange separate steel-foil portions only at the locations of the wall surface 14 of the shutter 4 which are in direct contact with ribs 14 and 15.

Figure 6:
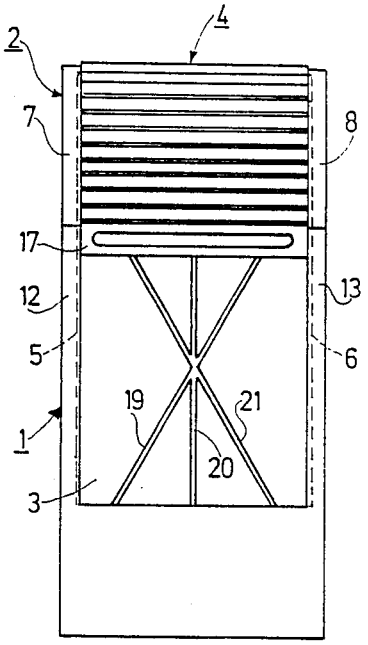
FIG. 6, in the same way as FIG. 1, shows a dry-shaving apparatus in which the sliding guide means comprise intersecting ribs arranged on the apparatus housing.

In the embodiment shown in FIG. 6 the sliding guide means also comprise ribs on the apparatus housing 3, namely three ribs 19, 20 and 21 arranged in an intersecting star-shaped pattern, the ribs being oriented to act substantially in the sliding direction of the shutter 4. These ribs 19, 20 and 21 function in the same way as the ribs 15 and 16 in the embodiment described in the foregoing. If desired a further rib which extends transversely through the star point may be provided. Obviously, further patterns of ribs which are essentially oriented in the direction of movement of the shutter are possible, such as for example, ribs which undulate in the sliding direction of the shutter.

Figure 7:
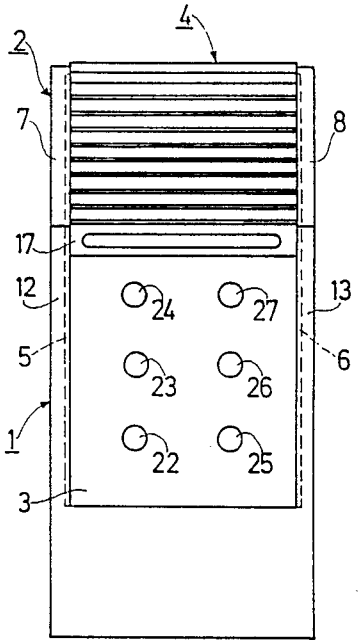
FIG. 7 in the same way as FIG. 1, shows a dry-shaving apparatus in which the sliding guide means comprises rolling elements.
Figure 9:
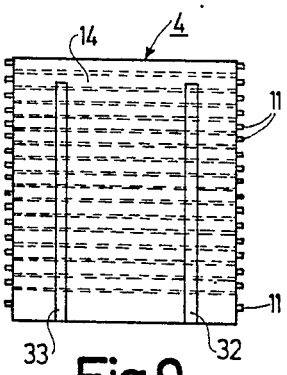
FIG. 9 shows a shutter intended for use in a dry-shaving apparatus as shown in FIG. 7 in a plan view at its wall surface which faces the apparatus housing of the dry-shaving apparatus on which it is mounted.

In the embodiment shown in FIG. 7 two sliding guide means are provided comprising rolling elements, in the present case, balls, which project from the apparatus housing 3 and which are disposed in line with each other in the sliding direction of the shutter 4. One sliding guide means then comprises the balls 22, 23 and 24 and the other sliding guide means comprises the balls 25, 26 and 27. In this way the sliding guide means provide localized areas of contact between the shutter 4 and the apparatus housing 3, the shutter and the apparatus housing being in contact with each other over very small areas corresponding to the ball portions projecting from the apparatus housing.

Figure 8:
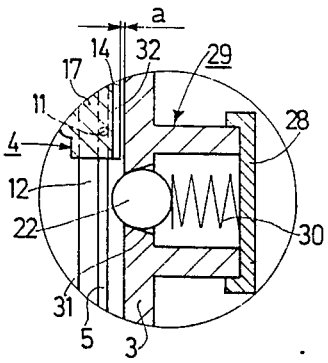
FIG. 8, in side view and in sectional view, shows a part of the shutter-guidance area in a dry-shaving apparatus as shown in FIG. 7.

FIG. 8 shows the arrangement of the balls, for example of the ball 22, in the apparatus housing 3, each of the balls being mounted in a cage 29 which is provided on the apparatus housing 3 and which is closed by a cap 28, a portion of said ball being urged out of said cage through an opening 31 in the apparatus housing 3 under the influence of a spring 30.

For the present sliding guide means it is found to be advantageous if the wall surface 14 of the shutter 4 which faces the apparatus housing 3 is provided with grooves 32 and 33 which extend in the sliding direction of the shutter and which are associated with the two sliding guide means, said grooves being engaged by the balls of the two sliding guide means on the apparatus housing 3. This improves the properties of the sliding guide means for the shutter, while at the same time rectilinear guideway for the movement of the shutter is obtained. The wall surface 14 of the shutter 4 which faces the apparatus housing 3 is then again situated at a distance a from the apparatus housing 3.

It is obvious that a series of modifications of the embodiments described in the foregoing are possible within the scope of the invention. This applies in particular to the arrangement and construction of the sliding guide means acting between the shutter and the apparatus housing.

What is claimed is:

1. A dry-shaving apparatus comprising at least one shutter which is slidable on the apparatus housing for optionally covering or exposing a shear foil of the dry-shaving apparatus, and which is laterally guided at both sides in groove-shaped guides on the apparatus housing, wherein the shutter-wall surface which faces the apparatus housing is spaced from the apparatus housing and at least one sliding guide means situated intermediate the lateral edges of the shutter acts between the shutter and the apparatus housing to provide localized areas of contact between the shutter and the apparatus housing in the sliding direction of the shutter.

2. A dry-shaving apparatus as claimed in claim 1, wherein the sliding guide means comprises at least one rib which is oriented to act substantially in the sliding direction of the shutter.

3. A dry-shaving apparatus as claimed in claim 2, wherein the rib is arranged on the apparatus housing.

4. A dry-shaving apparatus as claimed in claim 3, wherein the shutter-wall surface which faces the apparatus housing is provided with a steel foil in the area of the shutter end which is remote from the shear foil, the shutter sliding on the rib with said steel foil.

5. A dry-shaving apparatus as claimed in claim 1, wherein the sliding guide means comprises separate rolling elements which project from the apparatus housing and which are disposed in line with each other in the sliding direction of the shutter.

6. A dry-shaving apparatus as claimed in claim 5, wherein the shutter-wall surface which faces the apparatus housing is provided with a groove which extends in the sliding direction of said shutter and which is engaged by the rolling elements of the sliding guide means arranged on the apparatus housing.

7. A dry-shaving apparatus comprising at least one shutter which is slidable on the apparatus housing for optionally covering or exposing a shear foil of the dry-shaving apparatus, and which is laterally guided at both sides in groove-shaped guides on the apparatus housing, wherein the shutter-wall surface which faces the apparatus housing is spaced from the apparatus housing and at least one sliding guide means acts between the shutter and the apparatus housing to provide localized areas of contact between the shutter and the apparatus housing in the sliding direction of the shutter, said sliding guide means comprising at least one rib arranged on the housing and oriented to act substantially in the sliding direction of the shutter, and said shutter-wall surface being provided with a steel foil in the area of the shutter end which is remote from the shear foil, the shutter sliding on the rib with said steel foil.

8. A dry-shaving apparatus comprising at least one shutter which is slidable on the apparatus housing for optionally covering or exposing a shear foil of the dry-shaving apparatus, and which is laterally guided at both sides in groove-shaped guides on the apparatus housing, wherein the shutter-wall surface which faces the apparatus housing is spaced from the apparatus housing and at least one sliding guide means acts between the shutter and the apparatus housing to provide localized areas of contact between the shutter and the apparatus housing in the sliding direction of the shutter, said sliding guide means comprising separate rolling elements which project from the apparatus housing and which are disposed in line with each other in the sliding direction of the shutter.

9. A dry-shaving apparatus as claimed in claim 8 wherein said rolling elements are balls, each ball being mounted in a cage which is closed by a cap, a portion of the ball being urged out of said cage through an opening in the housing by a spring.

* * * * *